US007748461B2

(12) United States Patent
Loretz et al.

(10) Patent No.: US 7,748,461 B2
(45) Date of Patent: Jul. 6, 2010

(54) METHOD AND APPARATUS FOR MULTI-DROP TOOL CONTROL

(75) Inventors: Ives D. Loretz, Houston, TX (US); Alok Dwivedi, Baku, AZ (US); Darren Shove, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 147 days.

(21) Appl. No.: 11/851,532

(22) Filed: Sep. 7, 2007

(65) Prior Publication Data

US 2009/0065218 A1 Mar. 12, 2009

(51) Int. Cl.
*E21B 34/00* (2006.01)

(52) U.S. Cl. ..... 166/319; 166/320; 137/106

(58) Field of Classification Search ..... 137/119.03, 137/106, 119.02, 625.66; 166/320, 386, 166/319, 313, 374
See application file for complete search history.

(56) References Cited

U.S. PATENT DOCUMENTS 4,319,603 A * 3/1982 Snyder ..... 137/492.5
4,636,934 A 1/1987 Schwendemann et al.
6,125,938 A 10/2000 Garcia-Soule et al.
6,247,536 B1 6/2001 Leismer
6,502,640 B2 1/2003 Rayssiguier et al.
6,505,684 B2 1/2003 Rayssiguier et al.
6,523,613 B2 2/2003 Rayssiguier et al.
6,575,237 B2 6/2003 Purkis et al.
6,591,914 B2 7/2003 Williamson, Jr.
6,668,936 B2 12/2003 Williamson, Jr. et al.
6,745,844 B2 6/2004 Henderson
6,782,952 B2 8/2004 Garay et al.

* cited by examiner

*Primary Examiner*—William P Neuder
*Assistant Examiner*—Catherine Loikith
(74) *Attorney, Agent, or Firm*—Van Someren, PC; Daryl R. Wright; Brandon S. Clark

(57) ABSTRACT

A hydraulic actuator is connected between a downhole tool and a hydraulic control line for operating the downhole tool through an actuation sequence. The hydraulic actuator comprises a valve shuttle section having an inlet port in connection with the hydraulic control line, a first function port and a second function port. The hydraulic actuator also has a shuttle movable between positions providing fluid communication between the inlet port and the first function port and the inlet port and the second function port. Additionally, the hydraulic actuator has a pilot assembly in fluid connection with the hydraulic control line and in operational connection with the shuttle. The pilot assembly is movable in response to an actuation cycle comprising applying pressure from the hydraulic control line and bleeding the pressure off.

16 Claims, 3 Drawing Sheets

| | | VALVE # | | |
|---|---|---|---|---|
| | | 30a | 30b | 30c |
| ACTUATION CYCLE # | 0 | CLOSE | CLOSE | CLOSE |
| | 1 | OPEN | CLOSE | CLOSE |
| | 2 | CLOSE | OPEN | CLOSE |
| | 3 | OPEN | OPEN | CLOSE |
| | 4 | CLOSE | CLOSE | OPEN |
| | 5 | OPEN | CLOSE | OPEN |
| | 6 | CLOSE | OPEN | OPEN |
| | 7 | OPEN | OPEN | OPEN |

METHOD AND APPARATUS FOR MULTI-DROP TOOL CONTROL

FIELD OF THE INVENTION

The present invention relates in general to subsurface well completion equipment and, more specifically to mechanisms for operating multiple hydraulic downhole tools from a single hydraulic line.

BACKGROUND

It is well known that many downhole tools require power to operate, or shift from position to position in accordance with the tools intended purpose. It is therefore a desire to provide hydraulic power and the ability to more than one downhole tool from a minimal number of hydraulic control lines.

SUMMARY OF THE INVENTION

In view of the foregoing and other considerations, the present invention relates to a self-piloted actuator tool assembly.

Accordingly, methods, apparatus and systems for controlling one or more well tools through a single hydraulic control line are provided. In an embodiment of the invention a hydraulic actuator connected between a downhole tool and a hydraulic control line for operating the downhole tool through an actuation sequence includes a valve shuttle section having an inlet port in connection with the hydraulic control line, a first function port and a second function port, and a shuttle moveable between positions providing fluid communication between the inlet port and the first function port and the inlet port and the second function port; and a pilot assembly in fluid connection with the hydraulic control line and in operational connection with the shuttle, the pilot assembly movable in response to an actuation cycle comprising applying pressure from the hydraulic control line and bleeding the pressure off.

An example of a multi-drop tool system for a wellbore includes a first and a second piloted actuator tool assembly connected to a pipe string and disposed in a wellbore; and a hydraulic control line connected to the first and the second piloted actuator tool assembly, wherein each piloted actuator tool assembly is controlled by actuation cycles comprising applying pressure in the hydraulic control line and bleeding the applied pressure off.

A method of controlling multiple downhole well tools from a single hydraulic control line includes the steps of positioning multiple piloted actuator tool assemblies operable between a first position and a second position in a wellbore; connecting a hydraulic control line to the piloted actuator tool assemblies; and controlling each of the piloted actuator tool assemblies by performing an actuation cycle.

Each of the piloted actuator tool assemblies is self-piloted in the sense that as the actuation cycles, or pressure cycles, are provided through the hydraulic line each tool assembly controls its own actuation sequence. An example of a piloted actuator tool assembly includes a flow control valve moveable from an open position to a closed position; and an actuator having a pilot assembly and a shuttle, the hydraulic control line in communication with the pilot assembly and the flow control valve through the shuttle, the shuttle selectively moveable by the pilot assembly in response to the actuation cycles to operate the flow control valve between the open and the closed position.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figures 1A, 1B:
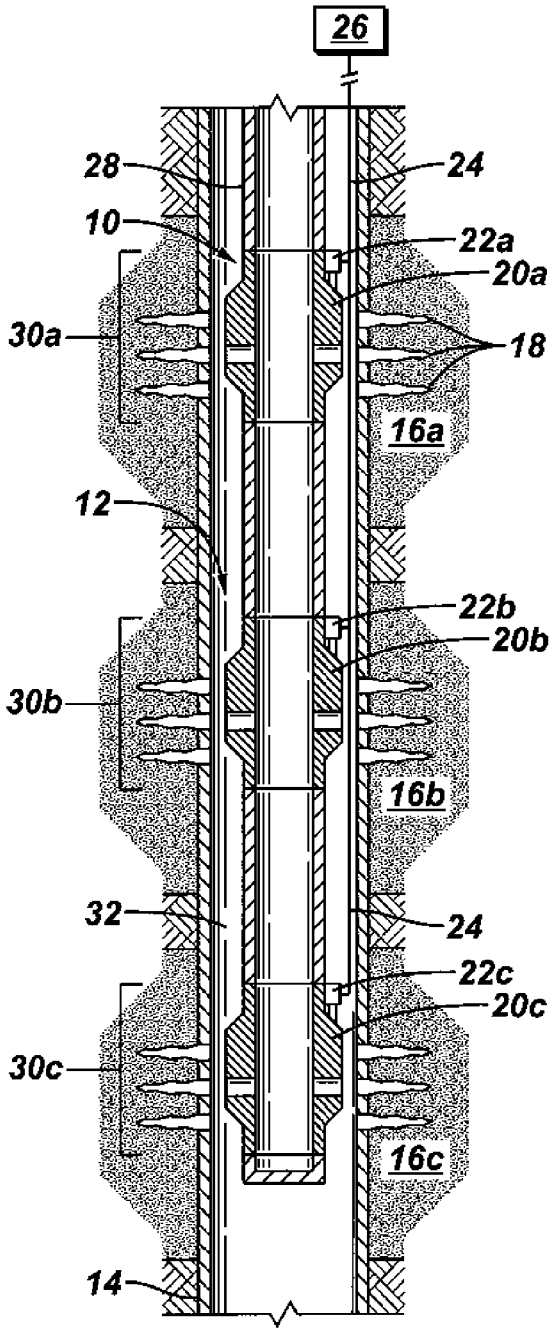
FIG. 1A is a schematic of a wellbore having a multi-drop tool system of the present invention.
FIG. 1B is a representation of an actuation sequence for each of the tool assemblies illustrated in FIG. 1A.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 illustrates a multi-drop tool system of the present invention, generally denoted by the numeral 10, installed in a wellbore 12. Wellbore 12 is commonly completed with casing 14. In the illustrated example, wellbore 12 is completed through three zones of interest 16*a*-16*c* by providing perforations 18 through casing 14.

Multi-drop tool system 10 includes multiple hydraulically operated tools 20, multiple actuators 22, and a hydraulic control line 24. Hydraulic tools 20 are illustrated and described herein as flow control valves, however, it should be understood that any device that may be actuated from one position to another position may be utilized. For example, tools 20 include flow control valves, formation isolation valves, packers, perforating guns and the like. It is also noted that the tool be operatable between at least two positions, such as open, closed or choked for valves as well as various other operation positions of other tools 20.

Hydraulic control line 24 extends from a control station 26, typically positioned at the surface, which commonly includes a hydraulic fluid reservoir, pumps, and electronic control equipment. It is recognized that system 10 may comprise a single tool 20 and its corresponding actuator 22, however the present invention is particularly adapted for multi-dropping, wherein multiple tools are connected to a single control line for operation. Actuators 22 are self-piloted actuators wherein each actuator may respond differently from another actuator in response to the same actuation cycle.

Valves 20 are positioned in wellbore 12 along a pipe string 28. Pipe string 28 may be constructed of jointed pipe, coiled tubing or the like. Each of the valves 20 is operationally connected to the single hydraulic control line 24. Each valve 20 is connected to control line 24 through a designated actuator 22. Thus, there is one actuator 22 for each valve 20, forming a piloted actuator valve assembly 30.

Actuators 22 of the present invention facilitate the control and operation of multiple tools 20 from a single control line 24 as described below with reference to FIG. 1B. It is noted that actuator 22 may be located in several locations such as in the annulus 32 between casing 14 and pipe string 28 as well as being incorporated into tool 20.

Figure 2:
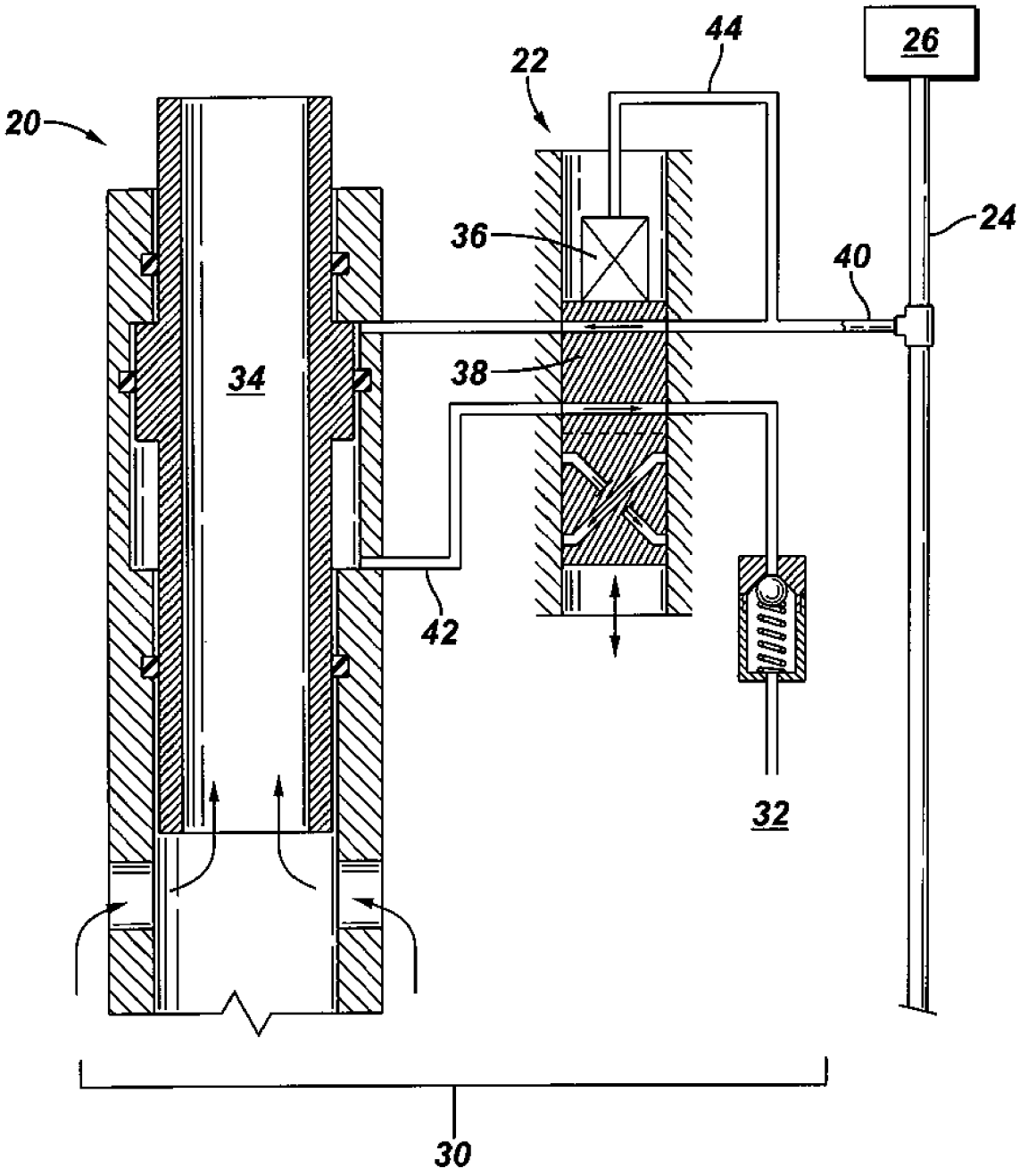
FIG. 2 is a schematic of a piloted actuator valve assembly.

Refer now to FIG. 2, wherein a schematic of a piloted actuator valve assembly 30 is shown in isolation. Assembly 30 includes a valve 20 and its corresponding piloted actuator 22. Valve 20 may be operated from a closed position to an open position (shown) in which fluid may flow between annulus 32 and the bore 34 of valve 20. Actuator 22 includes a pilot section 36 and a valve shuttle section 38. A conduit or supply line 40 is connected between hydraulic control line 24 and actuator 22. Supply line 40 is connected to valve 20 through valve shuttle section 38 to valve 20. The hydraulic pressure and fluid from control line 24 is selectively provided to valve 20 through actuation of valve shuttle section 38 by pilot section 36. A fluid return line 42 may be provided from valve 20 through valve shuttle section 38 for venting fluid to annulus 32 when moving valve 20 between positions. It should further be recognized that return line 42 may also serve as a supply line from actuator 22 to valve 20, as such hydraulic pressure can be provided through line 40 or line 42, each line actuating valve 20 to a different position. A vent line may be provided that returns to the surface or other location facilitating control of the back pressure an each actuator 22 and valve 20.

A pilot line 44 is split off of supply line 40 upstream of actuator 22 and directed to pilot section 36. Manipulation of the hydraulic pressure in control line 24 operates pilot section 36 which selectively actuates valve shuttle section 38. Actuation of shuttle valve section 38 operates valve 20 between its various positions.

Figure 3A:
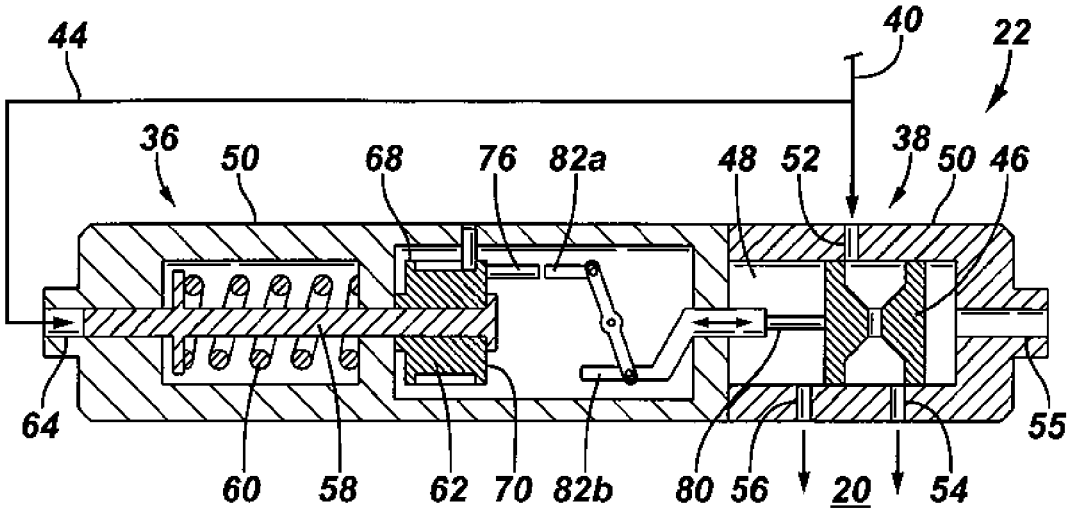
FIGS. 3A-3C are illustrations of an actuator of the present invention.
Figure 3B:
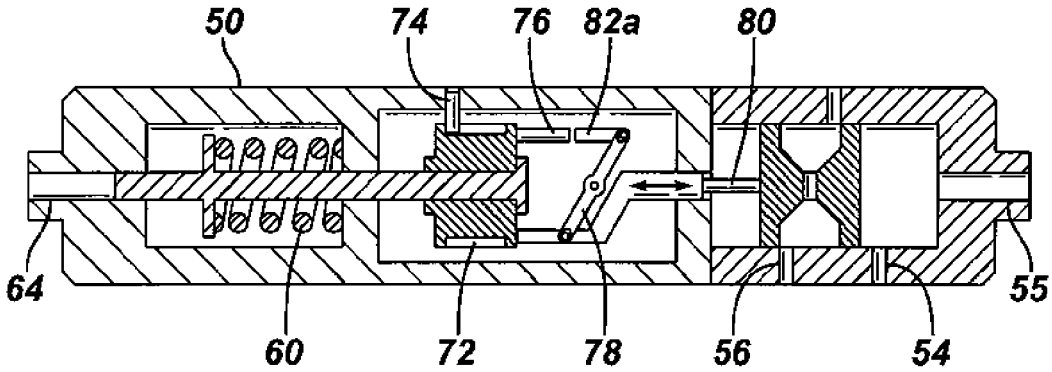
Figure 3C:
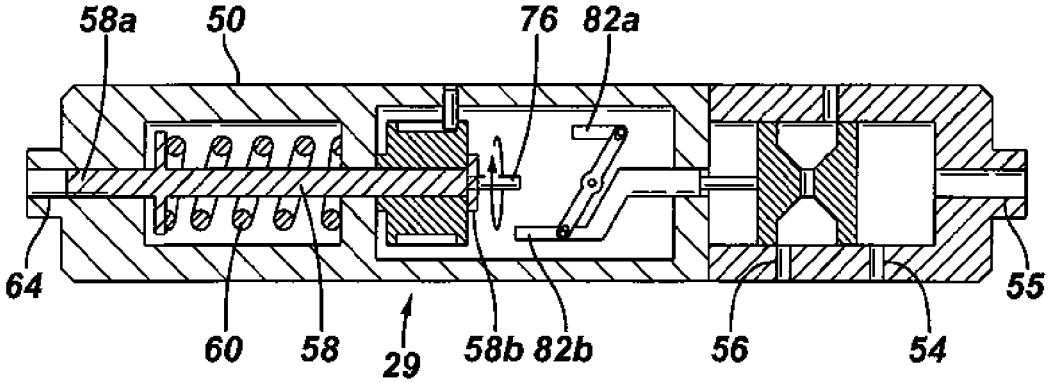

Refer now to FIGS. 3A through 3C wherein exploded views of actuator 22 are shown during various steps of operation. Actuator 22 includes pilot section 36 and valve shuttle section 38. Shuttle section 38 is illustrated and described herein as a two position shuttle valve mechanism. Shuttle section 38 includes a shuttle 46 moveable along a chamber 48 formed by a housing 50. A power supply port 52 is formed through housing 50 and in fluid connection with supply line 40 and control line 24 (FIG. 2).

Function ports 54 and 56 are formed through housing 50 and are in fluid and operational communication with valve 20. Each port serves to actuate valve 20 to a position or function when hydraulic pressure is supplied through the function port. A vent port 55 is provided through housing 50 to vent pressure and fluid as illustrated schematically in FIGS. 3A-3B.

Ports 54 and 56 are in fluid communication with valve 20. Shuttle 46 is moveable along chamber 48 to selectively provide fluid communication between supply port 52 and either of the function ports 54 or 56. By example, supplying hydraulic pressure through supply port 52 to first function port 54 operates valve 20 to the open position and providing hydraulic pressure through supply port 52 to second function port 56 operates valve 20 to the closed position.

Pilot section 36 is of a unique design providing functionality to shuttle valve section 38 that facilitates multi-dropping a plurality of tools 20 from a single hydraulic control line. Pilot section 36 includes a pilot assembly 29 in operational connection with shuttle valve 46. The pilot assembly includes a piston 58, biasing mechanism 60, and an indexer head 62 carrying a pushpin 76, and sequencing pattern consisting of track 72 and finger 74. The pilot assembly is mounted within housing or body 50 which includes a pilot port 64 that is in pressure communication with pilot line 44.

Piston 58 has a first end 58*a* and a head end 58*b*. First end 58*a* is disposed so as to be in operational and responsive communication with port 64 and the pressure provided from pilot line 44. Indexer head 62 is connected to head end 58*b*. Biasing mechanism 60, for example a spring, is connected to piston 58 so as to bias piston 58 in the opposite direction from the direction that it is urged by pressure through pilot port 64.

Indexer head 62 includes a circumferential, outer surface 68 and a front face 70. Grooves 72 are formed on surface 68 to mesh with a finger 74. It is noted that finger 74 may extend from head 62 and mate with grooves 72 formed by body 50. As known in the art, grooves 72 and finger 74 may comprise detents, ridges and other mechanisms known for creating a pattern of movement. Grooves 72 and finger 74 are understood to be, and are referred to herein, as an indexing mechanism.

A pushpin 76 extends outwardly from face 70 of indexer head 62 for selectively connecting with linkage mechanism 78. Linkage mechanism 78 includes a first end 80, such as a shaft, connected to shuttle element 46. The second end of linkage mechanism 78 includes a pair of contact ends 82*a* and 82*b*. For actuation of valve 20, pushpin 76 is urged into contact with one or the other of ends 82. Movement of the contact ends 82 results in shuttle 46 moving to the next function port. Shuttle valve 46 is moved in a first direction when contact end 82*a* is acted on and moves in a second opposite direction when contact end 82*b* is actuated.

Operation of multi-drop tool system 10 and actuator 22 is now described with reference to FIGS. 1 through 3. Wellbore 12 is completed with a pipe string 28 carrying three piloted actuator tool assemblies, designated as 30*a*, 30*b*, and 30*c*. A single hydraulic line 24 interconnects the assemblies 30 to control station 26.

In the initial position, run-in position, valves 20*a*, 20*b*, 20*c* may be in the closed position as shown in FIG. 1B. It is noted that the valves do not have to be in the same initial position. In the first operational step, also referred to as the pressure-up step, pressure is applied from control station 26 through control line 24. Pressure and fluid are provided from control line 24 to supply line 40 and pilot port 64 through pilot line 44. Pilot piston 58 moves laterally toward linkage 78 in response to the pressure at pilot port 64, compressing biasing mechanism 60. In this example, pushpin 76 contacts end 82*a* of linkage 78 causing shuttle element 46 to move from a first position port 54 to the second position port 56 (FIGS. 3A and 3B). In the example of FIG. 1B for valve 20*a*, movement of shuttle 46 causes valve 20 to be operated from the closed position to the open position. It should be noted that pushpin 76 and indexer head 62 may be oriented so that pushpin 76 does not contact linkage end 82 on specified pressure up steps as described in more detail below.

In a next operational step, the bleed-down or bleed-off pressure step, pressure is bled off of pilot port 64 and biasing mechanism 60 urges piston 58 back to its initial position. As piston 58 moves laterally to its initial position indexer head 62 rotates due to interaction of finger 74 in grooves 72. In this illustration, rotation of indexer head 62 positions pushpin 76 out of alignment with ends 82 of linkage 78. Thus, in the next pressure-up step the lateral movement of pushpin 76 will fail to contact either of ends 82 thereby not actuating shuttle 46 or valve 20 to the next position. Thus, actuation of valve 20 is skipped. The rotation of indexer head 62 may be individually programmed in the configuration of grooves 72, or the number of pushpins 76, to create various actuation sequences such as those represented by FIG. 1B.

Referring to FIGS. 1A and 1B in particular, each of the actuators 22*a*, 22*b*, 22*c* is programmed to have a particular actuation sequence for its corresponding valve. The actuation sequence is programmed by forming grooves 72 (or a track) or by varying the number of pushpins 76 in a manner such that actuation of shuttle 46 and valve 20 occurs on desired cycles. A cycle includes a step of pressuring up, causing indexer head 62 and pushpin 76 to move laterally toward linkage 78 and bleeding the pressure off causing indexer head 62 and pushpin 76 to both move laterally away from linkage 78 and to rotate.

Referring specifically to FIG. 1B, each valve assembly 30 (FIG. 1A) has a different actuation sequence. For example, assembly 30*a* is programmed such that valve 20*a* is actuated between the open and closed position on each cycle. Assembly 30*b* is programmed so that valve 20*b* skips actuation every other cycle. Thus, valve 20*b* is actuated between positions on every other cycle. Assembly 30*c* is programmed so that it skips actuation in three of every four cycles. It is noted that although the various examples indicate movement between open and closed positions, movement may be between various positions which for valves may be open, closed or choked positions.

From the foregoing detailed description of specific embodiments of the invention, it should be apparent that a system for hydraulically controlling and operating multiple wellbore tools from as single hydraulic control line that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A hydraulic actuator connected between a downhole tool and a hydraulic control line for operating the downhole tool through an actuation sequence, the actuator comprising:

a valve shuttle section having an inlet port in connection with the hydraulic control line, a first function port and a second function port, and a shuttle movable between positions providing fluid communication between the inlet port and the first function port and the inlet port and the second function port; and a pilot assembly in fluid connection with the hydraulic control line and in operational connection with the shuttle, the pilot assembly movable in response to an actuation cycle comprising applying pressure from the hydraulic control line and bleeding the pressure off.

2. The actuator of claim 1, wherein the pilot assembly includes:

a linkage connected to the shuttle; and a piston carrying an indexer, the piston being movable in response to the actuation cycle to contact and actuate the linkage upon selected movements of the piston.

3. The actuator of claim 2, wherein the linkage includes a first end connected to the shuttle and a first and a second contact end, wherein movement of the first contact end by the piston moves the shuttle in a first direction and movement of the second contact end by the piston moves the shuttle in a second direction.

4. The actuator of claim 2, wherein the piston and the indexer move laterally from an initial position toward the linkage in response to the applied pressure and wherein the piston moves laterally back to the initial position and the indexer rotates in response to the applied pressure bleeding off.

5. The actuator of claim 4, wherein the pilot assembly includes an indexing mechanism that defines the movement of the indexer head during each actuation cycle such that the shuttle is actuated to a next position on selected actuation cycles and the shuttle is not actuated on selected actuation cycles.

6. The actuator of claim 1, wherein the pilot assembly includes an indexing mechanism that defines the movement of the pilot assembly such that the shuttle is actuated to a next position on selected actuation cycles.

7. The actuator of claim 1, wherein the pilot assembly includes an indexing mechanism that defines the movement of the pilot assembly such that the shuttle is not actuated to a next position on selected actuation cycles.

8. The actuator of claim 1, wherein the pilot assembly includes an indexing mechanism that defines the movement of the indexer head during each actuation cycle such that the shuttle is actuated to a next position on selected actuation cycles and the shuttle is not actuated on selected actuation cycles.

9. A multi-drop tool system for a wellbore, the system comprising:

a first and a second pilot actuator tool assembly connected to a pipe string and disposed in a wellbore; and a hydraulic control line connected to the first and the second pilot actuator tool assembly, wherein each piloted actuator tool assembly is controlled by actuation cycles comprising applying pressure in the hydraulic control line and bleeding the applied pressure off, wherein each piloted actuator tool assembly includes a wellbore tool and an actuator having a shuttle element for operating the tool between a first and a second position and a pilot assembly in operational connection with the shuttle to actuate the shuttle on selected actuation cycles, the pilot assembly comprising:

a linkage connected to the shuttle; and a piston carrying an indexer having a pushpin adapted for selectively moving the linkage to actuate the shuttle.

10. The system of claim 9, wherein in response to the applied pressure each piston moves laterally from an initial position toward the linkage and wherein the piston moves laterally back to the initial position and the indexer rotates in response to bleeding the applied pressure off.

11. The system of claim 9, wherein each wellbore tool includes:

a valve movable from an open position to a closed position, the shuttle being selectively movable by the pilot assembly in response to the actuation cycles to operate the valve between the open and the closed position.

12. The system of claim 9, wherein each actuator includes:

a valve shuttle section having an inlet port in connection with the hydraulic control line, a first function port and a second function port, the shuttle being movable between positions providing fluid communication between the inlet port and the first function port and the inlet port and the second function port.

13. A method of controlling multiple downhole well tools from a single hydraulic control line, the method comprising:

providing multiple piloted actuator tool assemblies in which each piloted actuator tool assembly comprises a valve movable from an open position to a closed position; and an actuator having a pilot assembly and a shuttle, the hydraulic control line in communication with the pilot assembly and the valve through the shuttle, the shuttle selectively movable by the pilot assembly in response to the actuation cycles to operate the valve between the open and the closed position, the pilot assembly including a linkage connected to the shuttle; and a piston carrying an indexer, the piston being movable in response to the actuation cycle to contact and actuate the linkage upon selected movements of the piston;

positioning the multiple piloted actuator tool assemblies in a wellbore;

connecting a hydraulic control line to the piloted actuator tool assemblies; and controlling each of the piloted actuator tool assemblies by performing an actuation cycle.

14. The method of claim 13, wherein the actuation cycle includes the steps of applying pressure in the hydraulic control line and bleeding the applied pressure off.

15. The method of claim 13, wherein each piloted actuator tool assembly includes an indexing mechanism defining an actuation sequence of actuation cycles and wherein the piloted actuator tool assembly is operated between the open and closed position on selected actuation cycles.

16. The method of claim 13, wherein the actuation cycle includes the steps of applying pressure in the hydraulic control line and bleeding the applied pressure off, and wherein the indexer rotates in response to the step of bleeding the pressure off to a preselected position for either causing the valve to be actuated between the open and closed position or skipping actuation of the valve upon the next step of applying the pressure.

* * * * *